US011946189B2

(12) United States Patent
Leibman et al.

(10) Patent No.: US 11,946,189 B2
(45) Date of Patent: Apr. 2, 2024

(54) INFUSER AND RECEPTACLE FOR A LAUNDRY APPLIANCE

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); Veera Venkata Anil Bhaskar Prasad Seereddy, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 26 days.

(21) Appl. No.: 17/737,359

(22) Filed: May 5, 2022

(65) Prior Publication Data

US 2023/0357978 A1 Nov. 9, 2023

(51) Int. Cl.
*D06F 39/02* (2006.01)

(52) U.S. Cl.
CPC ..... *D06F 39/028* (2013.01)

(58) Field of Classification Search
CPC ..... D06F 39/02; D06F 39/028
See application file for complete search history.

(56) References Cited

U.S. PATENT DOCUMENTS 3,066,520 A * 12/1962 Jennings ..... D06F 39/02 68/17 R
8,122,741 B2 2/2012 Shin et al.
(Continued)

FOREIGN PATENT DOCUMENTS

CN 109112787 A * 1/2019 ..... D06F 39/022
CN 109112788 A * 1/2019 ..... D06F 33/00
(Continued)

OTHER PUBLICATIONS

Electronic translation of CN-109112787-A. (Year: 2019).*
(Continued)

*Primary Examiner* — Joseph L. Perrin
(74) *Attorney, Agent, or Firm* — Dority & Manning, P.A.

(57) ABSTRACT

A laundry appliance includes an infuser into which users may insert a dissolvable treatment material, such as detergent pods of scented pellets. The diffuser may be removably inserted into a receptacle at least partially contained within the cabinet of the laundry appliance. One or more of a moveable cap or lid may be configured to cover an opening at the top of the receptacle, thereby sealing the receptacle. Water or air may be introduced into the receptacle through a fluid inlet line. The water or air may pass through openings in the infuser and interact with the dissolvable treatment material to produce a treatment mixture of treatment material and water or air. The treatment material may then exit the receptacle through a fluid output line, where it may be delivered to a fluid distribution element extending into the laundering chamber of the laundry appliance. The fluid distribution may then distribute the treatment solution into the chamber and onto the articles of laundry. A controller of the laundry appliance may be configured to allow the introduction of water or air to the infuser at a predetermined time based in part on the length of the laundry cycle and/or the rate at which the dissolvable treatment material dissolves.

20 Claims, 5 Drawing Sheets

(56) References Cited

U.S. PATENT DOCUMENTS

| | | | | |
|---|---|---|---|---|
| 8,196,441 | B2 | 6/2012 | Hendrickson et al. | |
| 8,887,536 | B2 | 11/2014 | Kim et al. | |
| 10,954,623 | B2 | 3/2021 | Son et al. | |
| 2003/0205286 | A1 | 11/2003 | Hennemann et al. | |
| 2006/0213005 | A1 | 9/2006 | Tanaka | |
| 2008/0072693 | A1* | 3/2008 | Kim | D06F 58/203 74/17 |
| 2010/0011606 | A1 | 1/2010 | Kim et al. | |
| 2019/0301078 | A1 | 10/2019 | Leibman et al. | |
| 2020/0069145 | A1 | 3/2020 | Helms | |
| 2020/0248387 | A1* | 8/2020 | Lee | D06F 37/266 |
| 2020/0289693 | A1 | 9/2020 | Yoon et al. | |
| 2021/0179982 | A1 | 6/2021 | Piorkowski et al. | |
| 2021/0230785 | A1* | 7/2021 | Wright | D06F 39/02 |
| 2023/0122808 | A1* | 4/2023 | Leibman | D06F 39/026 68/12.18 |

FOREIGN PATENT DOCUMENTS

| | | | | |
|---|---|---|---|---|
| CN | 109112789 A * | 1/2019 | | D06F 39/022 |
| EP | 2210976 A1 * | 7/2010 | | D06F 58/203 |

OTHER PUBLICATIONS

Electronic translation of CN-109112788-A. (Year: 2019).*
Electronic translation of CN-109112789-A. (Year: 2019).*
Electronic translation of EP-2210976-A1. (Year: 2010).*

* cited by examiner

INFUSER AND RECEPTACLE FOR A LAUNDRY APPLIANCE

FIELD OF THE INVENTION

The present subject matter relates generally to laundry appliances, or more specifically, to systems for delivering to articles of laundry a dissolvable treatment fluid, such as soluble fragrance, from a receptacle to the laundering chamber.

BACKGROUND OF THE INVENTION

Numerous treatment fluids are available on that market that provide fragrance, detergent, or other treatment materials in a dissolvable form. Consumers have demonstrated a desire for such a dissolvable form due in part to the convenience of dealing with individually wrapped, premeasured treatments, rather than heavy bulk liquid containers that are difficult for some consumers to manage and can lead to spills and other messes.

Conventional laundry appliances lack any particularized way of receiving such dissolvable treatment materials. Typically, dissolvable treatment materials are introduced into the laundry appliance by simply tossing them into the laundering chamber along with articles of laundry prior to starting a cycle. This is inefficient because it takes no account of the length or conditions of the laundry cycle or the length of time necessary for the dissolvable treatment materials to dissolve. In some instances, for example in the context of washing machines, the dissolvable treatment materials dissolve too early in a cycle and deposit their contents while a wash cycle is in progress, resulting in some or all of the treatment materials being washed from the clothes by the washing process itself. In other instances, the dissolvable treatment materials may not fully dissolve prior to the end of a cycle, thus failing to deposit their full contents according to the manufacturer's recommendations.

Accordingly, a laundry appliance having components specifically intended to contain and dispense dissolvable treatment materials and their contents would be desirable. It would further be desirable for those components to be configured to allow for control of the timing and manner of dispensing of the dissolvable treatment materials and their contents.

BRIEF DESCRIPTION OF THE INVENTION

Advantages of the invention will be set forth in part in the following description, or may be apparent from the description, or may be learned through practice of the invention.

In one exemplary embodiment, a laundry appliance is provided, including a cabinet, a rotatable drum within the cabinet, the rotatable drum defining a chamber for the receipt of articles of laundry, a receptacle at least partially contained within the cabinet, a fluid input line in fluid communication with the receptacle, an infuser contained within the receptacle, and a fluid distribution element in fluid communication with the receptacle. The receptacle may further include an opening accessible from an exterior of the cabinet. The infuser may further be configured to hold a dissolvable treatment material. The fluid distribution element may be further configured for directing a treatment solution into the chamber.

In another exemplary embodiment, a laundry appliance is provided, including a cabinet, a rotatable drum within the cabinet, the rotatable drum defining a chamber for the receipt of articles of laundry, a receptacle at least partially contained within the cabinet, a fluid input line in fluid communication with the receptacle, an infuser contained within the receptacle, and a fluid distribution element in fluid communication with the receptacle. The receptacle may further include an opening accessible from an exterior of the cabinet. The fluid distribution element may be further configured for directing a treatment solution into the chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
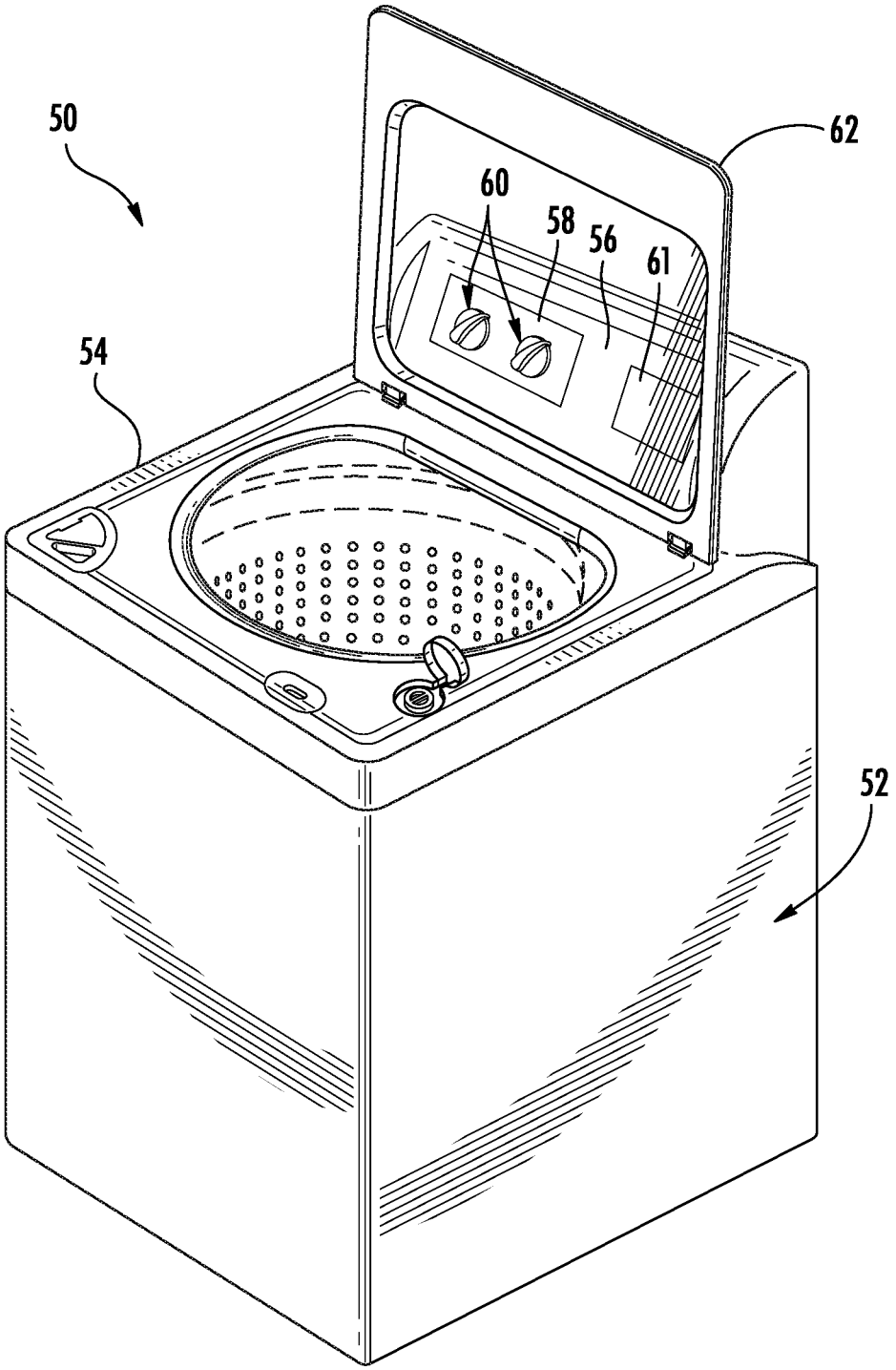
FIG. 1 provides a perspective appliance view of a laundry appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
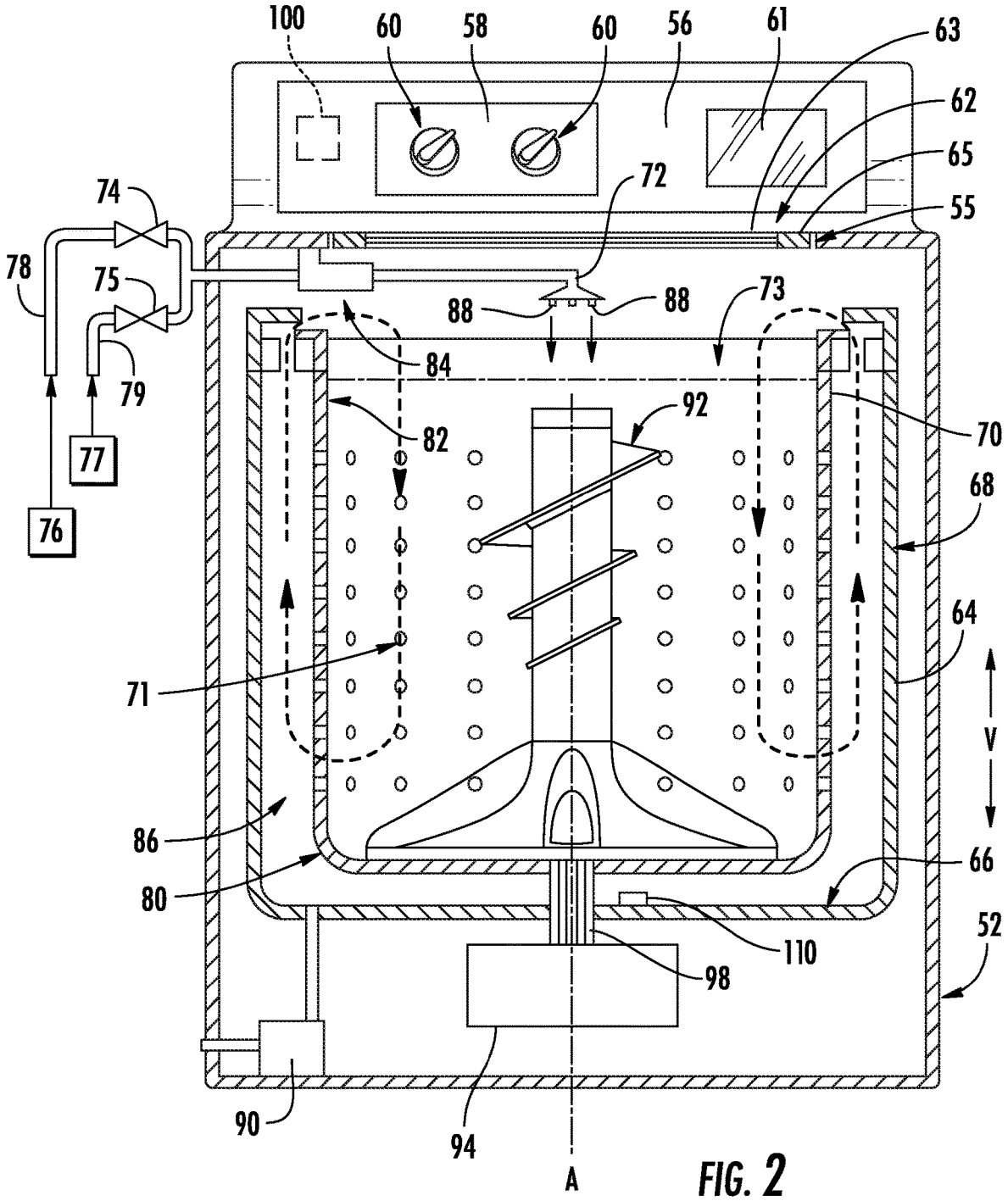
FIG. 2 provides a front view of the laundry appliance of FIG. 1 with a front portion of the laundry appliance removed to better illustrate exemplary internal components of the laundry appliance.

Turning now to the figures, FIGS. 1 and 2 provide separate views of a laundry appliance 50 according to exemplary embodiments of the present disclosure. As shown, laundry appliance 50 generally defines a vertical direction V, a lateral direction L, and a transverse direction T. The vertical direction V, lateral direction L, and transverse direction T are each mutually perpendicular and form an orthogonal direction system.

laundry appliance 50 may include a cabinet 52 having a top cover 54 that defines a vertical primary opening 55. A backsplash 56 extends from cover 54, and a control panel 58, including a plurality of input selectors 60, is coupled to backsplash 56.

Control panel 58 and input selectors 60 collectively form a user interface input for operator selection of machine cycles and features, and in one embodiment, a display 61 indicates selected features, a countdown timer, or other items of interest to machine users. It should be appreciated, however, that in other exemplary embodiments, the control panel 58, input selectors 60, and display 61, may have any other suitable configuration. For example, in other exemplary embodiments, one or more of the input selectors 60 may be configured as manual "push-button" input selectors, or alternatively may be configured as a touchscreen (e.g., on display 61).

A lid 62 may be mounted to cover 54 and rotatable between an open position (not shown) facilitating access to a tub, also referred to as a tub 64, located within cabinet 52 (e.g., via the primary opening 55) and a closed position (FIG. 1) forming an enclosure over tub 64. Lid 62 in exemplary embodiment includes a transparent panel 63, which may be formed of, for example, glass, plastic, or any other suitable material. The transparency of the panel 63 allows users to see through the panel 63, and into the tub 64 when the lid 62 is in the closed position. In some embodiments, the panel 63 itself can generally form the lid 62. In other embodiments, the lid 62 includes the panel 63 and a frame 65 surrounding and encasing the panel 63. Alternatively, panel 63 need not be transparent.

As may be seen in FIG. 2, tub 64 includes a bottom wall 66 and a sidewall 68. A drum or basket 70 is rotatably mounted within tub 64. In particular, basket 70 is rotatable about a central axis, which may when properly balanced and positioned in the embodiment illustrated be a vertical axis. Thus, laundry appliance is generally referred to as a vertical axis laundry appliance. Basket 70 defines a chamber 73 for receipt of articles for laundering and extends, for example, vertically, between a bottom portion 80 and a top portion 82. Basket 70 includes a plurality of openings or perforations 71 therein to facilitate fluid communication between an interior of basket 70 and tub 64.

A nozzle 72 is configured for flowing a liquid into tub 64. In particular, nozzle 72 may be positioned at or adjacent to top portion 82 of basket 70. Nozzle 72 may be in fluid communication with one or more water sources 76, 77 in order to direct liquid (e.g., water) into tub 64 or onto articles within chamber 73 of basket 70. Nozzle 72 may further include apertures 88 through which water may be sprayed into the tub 64. Apertures 88 may, for example, be tubes extending from the nozzles 72 as illustrated, or simply holes defined in the nozzles 72 or any other suitable openings through which water may be sprayed. Nozzle 72 may additionally include other openings, holes, etc. (not shown) through which water may be flowed (i.e., sprayed or poured) into the tub 64.

Various valves may regulate the flow of fluid through nozzle 72. For example, a flow regulator may be provided to control a flow of hot or cold water into the chamber 73 of laundry appliance 50. For the embodiment depicted, the flow regulator includes a hot water valve 74 and a cold water valve 75. The hot and cold water valves 74, 75 are used to flow hot water and cold water, respectively, therethrough. Each valve 74, 75 can selectively adjust to a closed position in order to terminate or obstruct the flow of fluid therethrough to nozzle 72. The hot water valve 74 may be in fluid communication with a hot water source 76, which may be external to the laundry appliance 50. The cold water valve 75 may be in fluid communication with a cold water source 77, which may be external to the laundry appliance 50. The cold water source 77 may, for example, be a commercial water supply, while the hot water source 76 may be, for example, a water heater. Such water sources 76, 77 may supply water to the appliance 50 through the respective valves 74, 75. A hot water conduit 78 and a cold water conduit 79 may supply hot and cold water, respectively, from the sources 76, 77 through the respective valves 74, 75 and to the nozzle 72.

An additive dispenser 84 may additionally be provided for directing an additive, such as detergent, bleach, liquid fabric softener, etc., into the tub 64. For example, dispenser 84 may be in fluid communication with nozzle 72 such that water flowing through nozzle 72 flows through dispenser 84, mixing with an additive at a desired time during operation to form a liquid, before being flowed into tub 64. For the embodiment depicted, nozzle 72 is a separate downstream component from dispenser 84. In other exemplary embodiments, however, nozzle 72 and dispenser 84 may be integral, with a portion of dispenser 84 serving as the nozzle 72, or alternatively dispenser 84 may be in fluid communication with only one of hot water valve 74 or cold water valve 75. In still other exemplary embodiments, the laundry appliance 50 may not include a dispenser, in which case a user may add one or more additives directly to chamber 73. A pump assembly 90 (shown schematically in FIG. 2) is located beneath tub 64 and basket 70 for gravity assisted flow to drain tub 64.

A known agitation element 92, such as a vane agitator, impeller, auger, or oscillatory basket mechanism, or some combination thereof is disposed in basket 70 and oriented to rotate about the rotation axis A (e.g., parallel to the vertical direction V), thereby imparting an oscillatory motion to articles and liquid in basket 70. In different embodiments, agitation element 92 may be a single action element (i.e., oscillatory only), double action (oscillatory movement at one end, single direction rotation at the other end) or triple action (oscillatory movement plus single direction rotation at one end, singe direction rotation at the other end).

In optional embodiments, basket 70 and agitation element 92 are both driven by a motor 94. Motor 94 may, for example, be a pancake motor, direct drive brushless motor, induction motor, or other motor suitable for driving basket 70 and agitation element 92. As motor output shaft 98 is rotated, basket 70 and agitation element 92 are operated for rotatable movement within tub 64 (e.g., about rotation axis A). Laundry appliance 50 may also include a brake assembly (not shown) selectively applied or released for respectively maintaining basket 70 in a stationary position within tub 64 or for allowing basket 70 to spin within tub 64.

Operation of laundry appliance 50 is controlled by a processing device or controller 100, that is operatively coupled to the input selectors 60 located on laundry backsplash 56 for user manipulation to select laundry cycles and features. Controller 100 may further be operatively coupled to various other components of appliance 50, such as the flow regulator (including valves 74, 75), motor 94, pressure sensor 110, other suitable sensors, etc. In response to user manipulation of the input selectors 60, controller 100 may operate the various components of laundry appliance 50 to execute selected machine cycles and features.

While described in the context of specific embodiments of laundry appliance 50, using the teachings disclosed herein it will be understood that laundry appliance 50 is provided by way of example only. Washing machine appliances and dryer appliances having different configurations, different appearances, or different features may also be used with the present subject matter as well.

Figure 3:
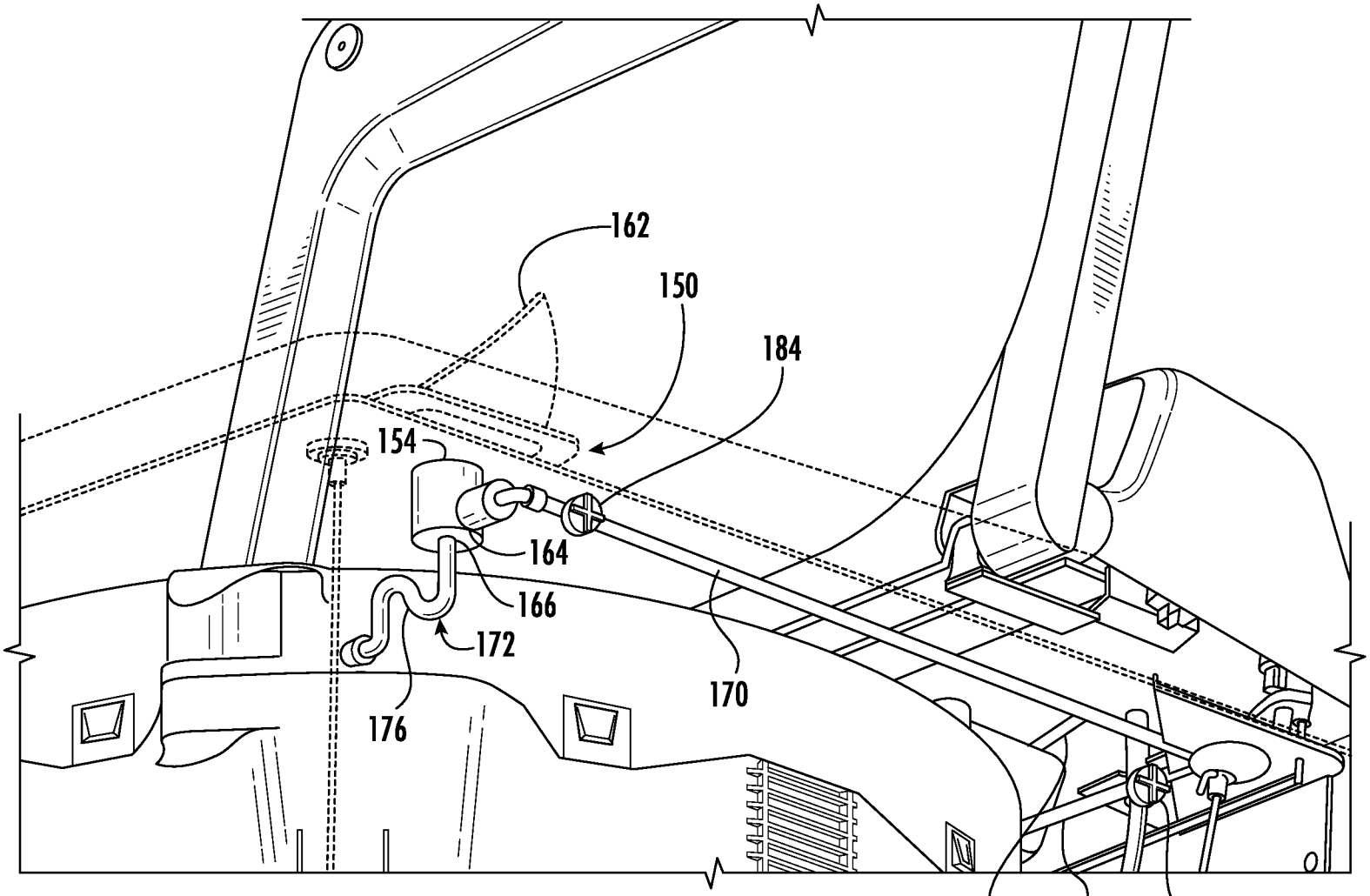
FIG. 3 provides a perspective view of an exemplary infuser assembly and its relationship to an exemplary fluid input line and fluid output line configuration.
Figure 4:
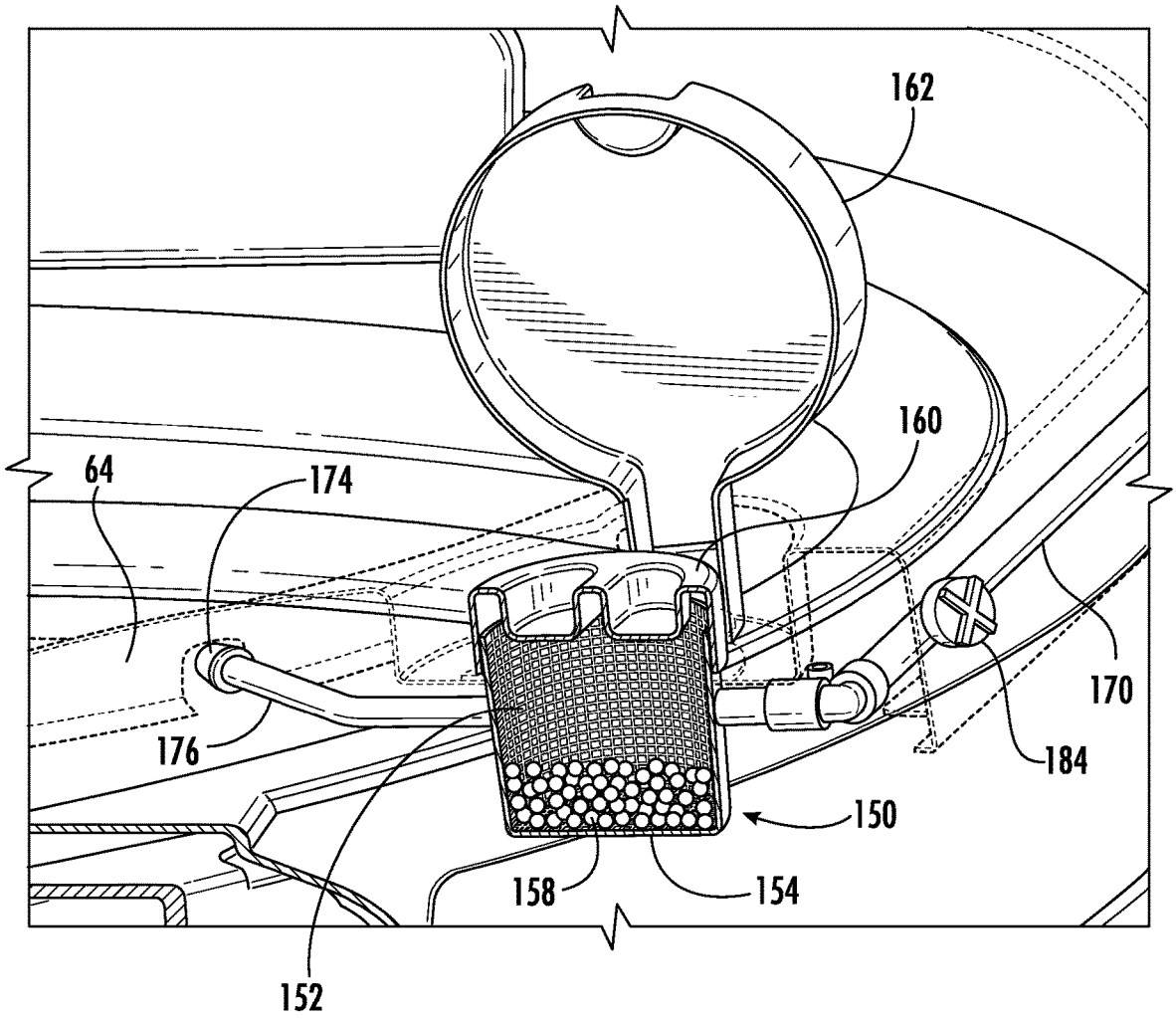
FIG. 4 provides a perspective view of an exemplary infuser assembly according to one embodiment of the present invention.
Figure 5:
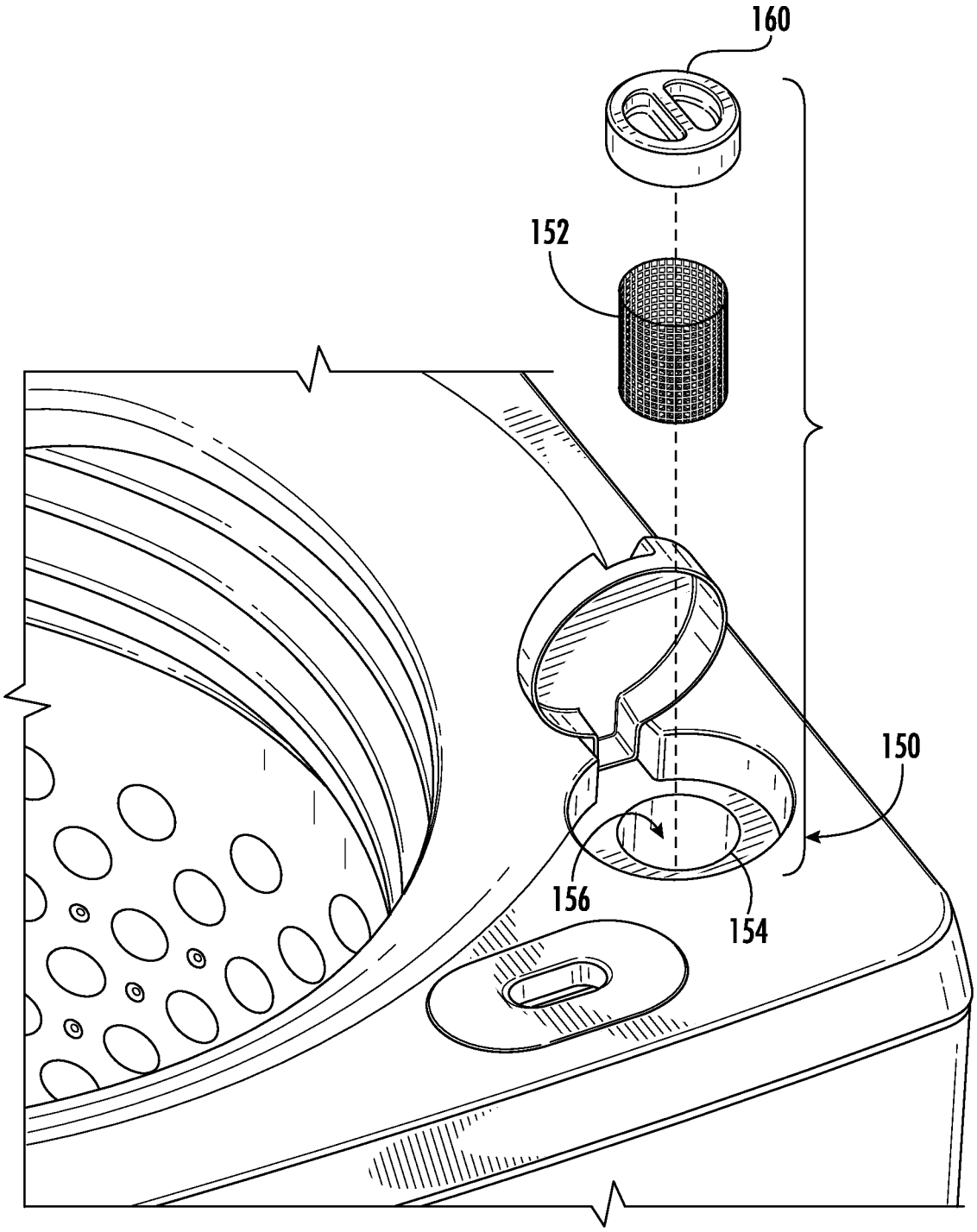
FIG. 5 provides an exploded perspective view of an exemplary infuser assembly with a lid in the open position according to one embodiment of the present invention.

Turning now especially to FIGS. 3 through 5, an exemplary infuser assembly 150 will be described in detail. Generally, infuser assembly 150 may be provided for supplying or infusing one or more additives to articles within the chamber 73 (e.g., separately from or in addition to detergent). As shown, infuser assembly 150 may generally include an infuser 152, a receptacle 154, and a cap 160. Infuser assembly 150 resides entirely or primarily within cabinet 52. An infuser assembly lid 162 may cover infuser assembly 150 and be accessible from the exterior of cabinet 52. Infuser assembly lid 162 may be movable between an open and closed position, wherein, in the closed position, infuser assembly lid 162 conceals infuser assembly 150 and, in the open position, provides access to infuser assembly 150. Infuser assembly lid 162 may be attached to cabinet 52 in certain embodiments. In alternative embodiments, infuser assembly lid 162 may be attached to infuser assembly 150.

Infuser assembly lid 162, in the closed position, covers a receptacle opening 156. Receptacle opening 156 is defined by receptacle 154 and is accessible from the exterior of cabinet 52 (e.g., by opening infuser assembly lid 162 and removing cap 160. In particular, receptacle 154 may generally be a container for holding liquids and other fluids, as well as infuser 152 as further described herein. As such, receptacle 154 may include walls that enclose all sides except for the uppermost horizontal plane, wherein receptacle opening 156 is situated. A receptacle input port 164 may be situated on one wall of receptacle 154 for introducing fluids to the receptacle, as further described herein. A receptacle output port 166 may also be situated on one wall of receptacle 154 to allow fluids to exit receptacle 154 as further described herein. Receptacle 154 may be at least partially contained within cabinet a 52.

Generally, receptacle opening 156 of receptacle 154 may be covered by a removable cap 160, as noted previously. Cap 160 may be generally attached to receptacle 154. In some embodiments, receptacle 154 may include attachment threads that correspond to attachment threads on cap 160, thereby enabling cap 160 to be screwed on to receptacle 154. In alternative embodiments, cap 160 may be attached to one side of receptacle 154 and may pivot open and closed over receptacle opening 156. Other conventional means of attachment of cap 160 to receptacle 154 will be understood by one of ordinary skill in the art and are intended to fall within the scope of the present disclosure. Regardless of the means of attachment, cap 160 may include a gasket located such that, upon attachment of cap 160 to receptacle 154, the gasket is compressed between cap 160 and receptacle 154, providing a seal to prevent the escape of fluids within receptacle 154. In alternative embodiments, infuser assembly 150 may lack cap 160 and instead infuser assembly lid 162 may include a gasket that creates a seal above receptacle opening 156, thereby sealing receptacle 154. In still other embodiments lacking cap 160, infuser assembly lid 162 may include a gasket that seals against a chamber above receptacle 154. In this embodiment, receptacle 154 may be considered sealed by infuser assembly lid 162, despite that fluid may occupy the chamber above the receptacle 154.

Infuser 152 may be removably contained within receptacle 154. Infuser 152 is configured to hold a dissolvable treatment material 158 supplied by the user. Users may access infuser 152 by opening infuser assembly lid 162 and removing or otherwise moving cap 160 to expose receptacle opening 156 of receptacle 154. The user may reach through receptacle opening 156 and pick up infuser 152, which may rest within receptacle 154 without attachment. Dissolvable treatment materials 158 (e.g., scent pellets) may then be added to infuser 152, which is then replaced within receptacle 154. In alternative embodiments, dissolvable treatment materials 158 may be poured directly into infuser 152 without removing it from receptacle 154. In certain situations, it may also be desirable to remove infuser 152 from receptacle 154 to clean infuser 152 or to otherwise remove any debris from that may obstruct the flow of fluids through infuser 152 as further described herein.

Infuser 152 may take a wide variety of forms. For example, in some embodiments, infuser 152 may have substantially the same shape as receptacle 154 and may similarly include an opening at its upper, horizontal surface for the depositing dissolvable treatment material 158. In alternative embodiments, infuser 152 may be fully enclosed and may have a latching or other locking mechanism to enable the user to open infuser 152, insert dissolvable treatment material 158, and then close infuser 152. In still other embodiments, infuser 152 may include a door or port that may be opened and fixedly closed by the user, again to allow for the insertion of dissolvable treatment materials. Generally, the design of infuser 152 must be enclosed at least along the sides and bottom of infuser 152 to prevent dissolvable treatment materials 158 from traveling out of infuser 152 prior to be dissolved. Further, infuser 152 must include perforations, gaps, slots, or other openings in the enclosure that permit fluids to enter and exit from infuser 152 but prevent dissolvable treatment materials from exiting the enclosure prior to dissolving. As such, it is necessary that these openings be smaller in size that the dissolvable treatment materials 158 themselves (e.g., less than approximately 10 millimeters in width). In the embodiment of FIG. 5, infuser 152 may have mesh sides, but this is not required to practice the present disclosure.

A fluid input line 170 may be connected to the receptacle input port 164 of receptacle 154 such that fluid input line 170 and receptacle 154 are in fluid communication. Fluid input line 170 may deliver fluids into receptacle 154 for mixing with the dissolvable treatment materials 158 in infuser 152, as further discussed herein. A fluid input valve 184 may be situated on fluid input line 170 to control the flow of fluids into receptacle 154.

Fluid input line 170 may be configured to introduce water, air, or both into receptacle 154. For example, in one embodiment, fluid input line 170 may be configured to optionally provide both water and air. It should be noted that only water or air is provided at any given time, but that fluid input line 170 is configured to provide the appropriate fluid at any given time in this embodiment. Here, fluid input line 170 may further include a water inlet portion 178 and a pressurized air inlet portion 180. Both water inlet portion 178 and pressurized air inlet portion 180 are connected to and in fluid communication with fluid input line 170. Water inlet portion 178 may further be connected to a domestic water supply (e.g., city water or well) that provides water under pressure. Pressurized air inlet portion 180 may further be connected to an air compressor in some embodiments such that air may be provided under pressure. Alternative techniques for generating air pressure are also known to those of ordinary skill and are intended to fall within the scope of the present disclosure.

In this embodiment, the pressurized air inlet portion 180 may connect to fluid input line 170 downstream from the point of connection between water inlet portion 178 and fluid input line 170. Further, a water valve 182 may be situated within water inlet portion 178 to control the flow of water and may be further be situated upstream from the point of connection between pressurized air inlet portion 180 and fluid input line 170. In this way, water may be prevented from flowing to receptacle 154 when air is intended to be introduced. Likewise, when water is intended to be introduced to receptacle 154, the source of the air pressure (e.g., a compressor) may be disabled. Additionally, or alternatively, another valve could be added to the pressurized air inlet portion to control the flow of air.

As noted, in some embodiments, fluid input line 170 may be configured to provide only water. In this embodiment, fluid input line 170 may itself be connected to a domestic water supply (e.g., city water or well) providing water under pressure. In this embodiment, fluid input valve 184 would be provided as previously explained, but water valve 182 would not be necessary. In an alternative embodiment for which fluid input line 170 is configured to provide only air, fluid input line itself may be connected to an air pressure generation source, such as a compressor.

Fluid output line 172 may be connected to receptacle output port 166 and may be in fluid communication with receptacle 154. In some embodiments, fluid output line 172 may connect to receptacle output port 166 on a bottom side of receptacle 154 to maximize the amount fluids to be removed from receptacle 154 (FIG. 3), although such a configuration in not required. In certain embodiments, fluid output line 172 may further include a p-trap 176 to provide for evacuation of water from receptacle 154 once use of infuser assembly 150 is complete and fluid input valve 184 has been closed. Additionally, or alternatively, the bottom of receptacle 154 may be sloped at an angle toward receptacle output port 166 to aid in drainage. This drainage is important in when the fluid is water because the dissolvable treatment material 158 will continue to dissolve in any remaining water even after use of infuser assembly 150 is complete, presenting an unnecessary waste.

Fluid output line 172 may deliver a treatment mixture from receptacle 154 to a fluid distribution element 174. The treatment mixture may include a combination of the fluid introduced by fluid input line 170 (e.g., water or air) and a portion of the dissolvable treatment material 158, as further described herein. Fluid distribution element 174 may extend through tub 64. Upon receipt of the treatment mixture from fluid output line 172, fluid distribution element 174 may be configured to direct the treatment mixture in chamber 73. For this purpose, fluid distribution element 174 may constitute a nozzle, atomizer, mister, or other device for directing the treatment mixture into chamber 73.

Controller 100 may be operably coupled to various components of laundry appliance 50 to control various functionality of laundry appliance 50. For example, controller 100 may be operably coupled to control panel 58, the plurality of input selectors 60, water valve 182, fluid input valve 184, and the source of pressurized air (e.g., a compressor). In one embodiment, a user may add scented pellets to infuser 152 and provide input at the plurality of input selectors 60 or control panel 58 to use water to provide fragrance to a load of laundry. At a predetermined point in a laundry cycle, controller 100 opens water valve 178 and fluid input valve 184, allowing water to flow through water inlet portion 178, into fluid input line 170, and into receptacle 154. The predetermined point in the laundry cycle may vary depending on the type of laundry cycle and rate at which dissolvable treatment material 178 dissolves. In certain embodiments, it may desirable that the treatment mixture, further discussed below, be introduced to chamber 73 after a rinsing cycle is complete to prevent the treatment mixture from being washed away from the laundry after treatment.

Within receptacle 154, water flows into infuser 152 where it washes over dissolvable treatment material 178. Dissolvable treatment material 178 begins to dissolve, releasing portions of the dissolvable treatment material 178 into the water stream to form a treatment mixture. As additional water flows into receptacle 154, the treatment mixture is motivated through receptacle output port 166 and into fluid output line 172. Fluid output line 172 delivers the treatment mixture to fluid distribution element 174, which directs the treatment mixture into chamber 73. Articles of laundry within chamber 73 are thus treated with the treatment mixture.

The process is similar in embodiments involving only air. Controller 100 may be configured to activate a source of air pressure (e.g., a compressor) and to open fluid input valve 184. Air flows into receptacle 154 where passes into infuser 152 and interacts with dissolvable treatment material 158. Although air does not cause dissolvable treatment material 158 to dissolve, in some embodiments the dissolvable treatment material may be a scented material that emits a fragrance, though perhaps to a lesser extent, even in the absence of dissolving. In such cases, passing the air over the dissolvable treatment material may create a treatment mixture of air and fragrance that be carried out of receptacle 154. The treatment mixture exits receptacle 154 through fluid output line 172 and is distributed into chamber 73 through fluid distribution element 174.

Although the present disclosure is generally directed to the operation of laundry appliance in the context of operations of a washing machine, the present disclosure may be equally implemented in a dryer appliance applying the same principles disclosed herein. Although the mechanics of introducing a treatment mixture to the drying chamber in a dryer appliance would be substantially the same, the timing of such introduction may differ. As with a washing machine appliance, the controller would need to be configured to determine the appropriate time to introduce water or air into the infuser assembly, and thus into the drying chamber. That determination would again be based on the drying cycle employed and/or the time necessary for dissolving of the dissolvable treatment material. However, a different consideration in the context of the dryer appliance would include the requirement that sufficient drying time remains, if introducing a water-based treatment mixture onto the laundry articles, for the laundry articles to fully dry prior to the end of the cycle. Other differences will be apparent to those of ordinary skill in the art in view of the disclosure herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry appliance comprising:

a cabinet;

a rotatable drum within the cabinet, the rotatable drum defining a chamber for the receipt of articles of laundry;

a receptacle at least partially contained within the cabinet and having an opening accessible from an exterior of the cabinet;

a fluid input line in fluid communication with the receptacle wherein the fluid input line further includes a water inlet portion and a pressurized air inlet portion;

an infuser contained within the receptacle and configured to hold a dissolvable treatment material;

a fluid distribution element in fluid communication with the receptacle and configured for directing a treatment mixture into the chamber; and a fluid input valve configured to selectively permit the flow of fluids from the water inlet portion and the pressurized air inlet portion, wherein the valve only permits the flow of fluids from one of the water inlet portion and the pressurized air inlet portion at any given time during operation of the laundry appliance.

2. The laundry appliance of claim 1, wherein the infuser is removable from the receptacle.

3. The laundry appliance of claim 1, the laundry further comprising a cap removably positioned over the opening of the receptacle and configured to seal the receptacle.

4. The laundry appliance of claim 1, the laundry appliance further comprising a fluid output line in fluid communication with the receptacle and the fluid distribution element.

5. The laundry appliance of claim 4, wherein the fluid output line further includes a p-trap.

6. The laundry appliance of claim 1, wherein the infuser further includes a bottom surface and one or more side surfaces extending generally vertically, the one or more side surfaces extending from the bottom surface and defining an opening for depositing of the dissolvable treatment materials.

7. The laundry appliance of claim 6, wherein the bottom surface and the one or more side surfaces each include a plurality of perforations.

8. The laundry appliance of claim 7, wherein the perforations have a width of less than about 10 millimeters.

9. The laundry appliance of claim 8, wherein the bottom surface and the one or more side surfaces comprise mesh surfaces.

10. The laundry appliance of claim 1, wherein the receptacle further includes a bottom surface, at least a portion of the bottom surface of the receptacle being sloped toward an output port located on the bottom surface of the receptacle, the output port in fluid communication with the fluid distribution element.

11. A laundry appliance comprising:

a cabinet;

a rotatable drum within the cabinet, the rotatable drum defining a chamber for the receipt of articles of laundry;

a receptacle at least partially contained within the cabinet and having an opening accessible from an exterior of the cabinet;

a fluid input line in fluid communication with the receptacle wherein the fluid input line further includes a water inlet portion and a pressurized air inlet portion;

an infuser contained within the receptacle;

a fluid distribution element in fluid communication with the receptacle and configured for directing a treatment mixture into the chamber; and a fluid input valve configured to selectively permit the flow of fluids from the water inlet portion and the pressurized air inlet portion, wherein the valve only permits the flow of fluids from one of the water inlet portion and the pressurized air inlet portion at any given time during operation of the laundry appliance.

12. The laundry appliance of claim 11, wherein the infuser is removable from the receptacle.

13. The laundry appliance of claim 11, the laundry further comprising a cap removably positioned over the opening of the receptacle and configured to seal the receptacle.

14. The laundry appliance of claim 11, the laundry appliance further comprising a fluid output line in fluid communication with the receptacle and the fluid distribution element.

15. The laundry appliance of claim 14, wherein the fluid output line further includes a p-trap.

16. The laundry appliance of claim 11, wherein the infuser further includes a bottom surface and one or more side surfaces extending generally vertically, the one or more side surfaces extending from the bottom surface and defining an opening for depositing of a dissolvable treatment material.

17. The laundry appliance of claim 16, wherein the bottom surface and the one or more side surfaces each include a plurality of perforations.

18. The laundry appliance of claim 17, wherein the perforations have a width of less than about 10 millimeters.

19. The laundry appliance of claim 18, wherein the bottom surface and the one or more side surfaces comprise mesh surfaces.

20. The laundry appliance of claim 11, wherein the receptacle further includes a bottom surface, at least a portion of the bottom surface of the receptacle being sloped toward an output port located on the bottom surface of the receptacle, the output port in fluid communication with the fluid distribution element.

* * * * *